United States Patent [19]

Arnoux et al.

[11] 4,216,452

[45] Aug. 5, 1980

[54] ELECTROMAGNETIC RELAY WITH DOUBLE-BREAKING CONTACTS

[75] Inventors: Daniel Arnoux, Saint Germain en Laye; Gérard Koehler, Ville d'Avray; Bernard Michel, Conflans Saint Honorine; Claude Genter; Jean Aguettaz, both of Paris; Alain Berthelot, Saint Germain, all of France

[73] Assignee: Societe Chauvin Arnoux, Paris, France

[21] Appl. No.: 918,503

[22] Filed: Jun. 23, 1978

[30] Foreign Application Priority Data

Jun. 23, 1977 [FR] France ..... 77 19218

[51] Int. Cl.[2] ..... H01H 67/02; H01H 63/02

[52] U.S. Cl. ..... 335/128; 200/67 D; 335/107; 335/129; 335/133

[58] Field of Search ..... 335/107, 127, 128, 131, 335/133, 135, 129; 200/67 D, 67 DA, 250

[56] References Cited

U.S. PATENT DOCUMENTS

| | | | |
|---|---|---|---|
| 2,997,560 | 8/1961 | Callaway | 335/128 X |
| 3,305,718 | 2/1967 | Waldron | 335/128 X |

FOREIGN PATENT DOCUMENTS

| | | | |
|---|---|---|---|
| 1204768 | 1/1960 | France | 335/107 |
| 647858 | 10/1962 | Italy | 335/135 |

*Primary Examiner*—Fred L. Braun

[57] ABSTRACT

Electromagnetic relay comprising resilient U-shaped tongues having each a pair of arms resiliently engaging fixed contact studs for electrically interconnecting them, and a movable control member adapted to move one of the arms of each tongue away from the corresponding contact stud, for breaking the electric connection. This relay further comprises a second control member movable in a direction opposite to that of the first control member and adapted to co-operate with the first control member for clamping the U-shaped tongue and move the two arms thereof away from the relevant contact studs.

9 Claims, 2 Drawing Figures

ELECTROMAGNETIC RELAY WITH DOUBLE-BREAKING CONTACTS

BACKGROUND OF THE INVENTION

This invention relates in general to electromagnetic relays and has specific reference to a relay of this character which comprises an electromagnet, and armature movable between first and second positions, first and second contact studs fixed in relation to the electromagnet, a pair of arms consisting of first and second arms tending resiliently to move away from each other and carrying each on their outer surface first and second electric contact surfaces electrically interconnected and bearing resiliently, in the first position of the armature, against the inner face of said first and second contact studs, respectively, said relay further comprising a movable control member associated kinematically with said armature and adapted, during a movement of said armature towards its second position, to engage the outer face of the first arm in order to move the first contact surface away from said first contact stud.

Relays of this general type are known as "permissive maker relays" in that they correspond to the idea that contacts close by themselves when they are authorized to do so.

DESCRIPTION OF THE PRIOR ART

An article entitled "Development of the Permissive-Make Relay" published in "IBM Journal", July 1957, discloses a relay with reversing contacts of this type, wherein the electromagnet actuates an insulating member of which some push portions open contacts previously closed by their inherent resilient force, while other push portions permit the closing of identical, previously open contacts.

This type of contact is advantageous in that the contact forces are independent of the armature stroke.

The tendency of contacts to rebound and their resistance to shocks are also advantageously modified due to the separation thus introduced between the closed contacts and the armature movements at the end of the armature stroke.

However, in certain relay application, notably for railroad applications, it is preferred to have double-break contacts for improving the breaking power.

It is also desirable to minimize the contact resistance between the second contact surface and the second contact stud.

These features are observed in the reversing contacts with a common point and double-break property disclosed in the French Pat. Nos. 1,204,768 and 1,547,322.

However, these contacts are very sensitive to shocks and in addition they are difficult to adjust, for the proper and simultaneous alignment of two contacts per reversing contact, i.e. 8 contacts in a relay comprising 4 inverters, must be obtained. Any misalignment is attended by variations in the contact force, whereas in the "Permissive-Make" contact type a misalignment is attended by a variation of the breaking distance, which may be accepted if this distance increased.

It is the essential object of the present invention to preserve the advantageous features of either of these two arrangements while avoiding their inconveniences. Other advantages of the present invention will appear presently.

The relay according to this invention is characterized essentially in that it comprises, in addition, a second control member associated kinematically with the armature and also with the first control member, and movable in direction opposed to that of the movement accomplished by the first control member, this second control member being adapted, during the movement of the armature towards its second position, to engage the outer faces of the second arm in order to move the second contact surface away from the second contact stud, the first and second contact surfaces then moving towards each other by performing substantially identical and simultaneous movements.

In case the relay according to the present invention comprised a third contact stud and a second pair of arms consisting of a third and fourth arms tending to move resiliently away from each other and supporting electrically interconnected third and fourth contact surfaces, so that the two pairs of arms disposed side by side have their respective first and fourth arms disposed on either side of the first control member, and their second and third arms located respectively in the vicinity of the second and third contact studs, and that the first control member actuates the first arm in the second position of said armature, and the fourth arm in the first position of the armature, this relay advantageously comprises a third control member fixed in relation to the second control member, in order to move the third contact surface away from the third contact stud during the movement of said armature towards its first position.

Other features and arrangements of the present invention will appear as the following description proceeds with reference to the accompanying drawing illustrating diagrammatically by way of example a typical embodiment thereof.

DESCRIPTION OF THE PREFERRED EMBODIMENT

Figure 2:
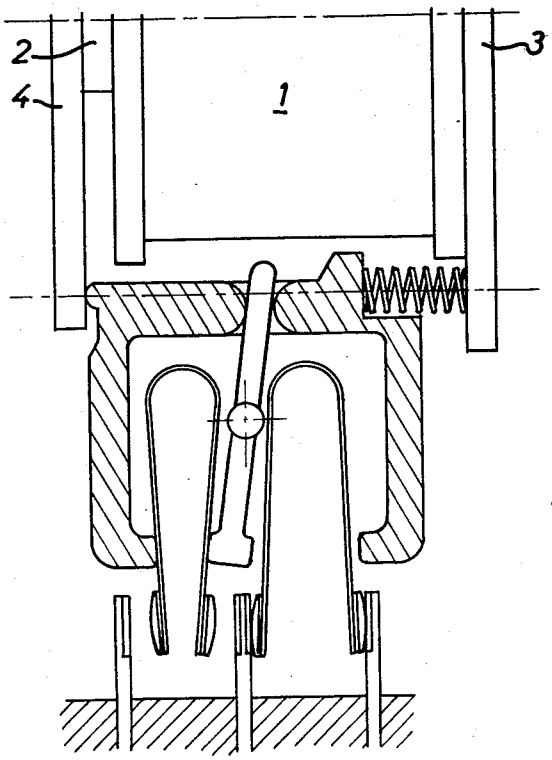
FIG. 2 is a view similar to FIG. 1, showing the relay in its operative position.
Figure 1:
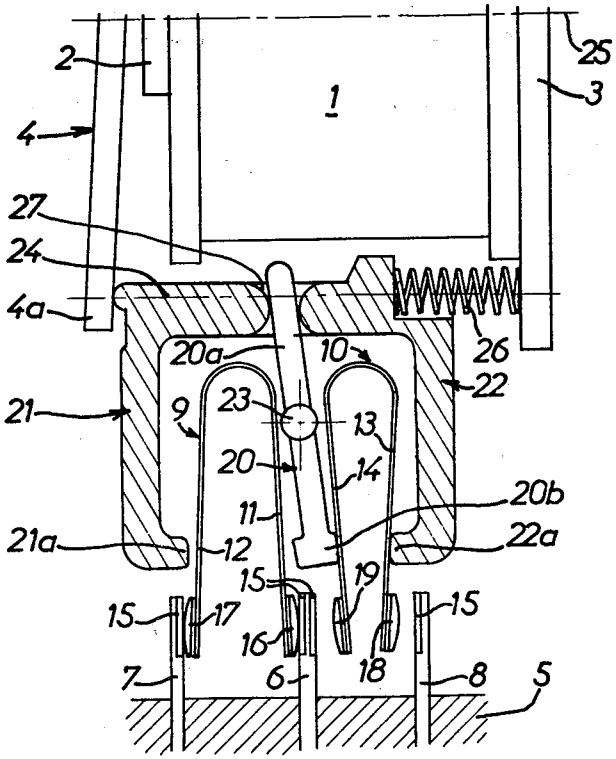
FIG. 1 is a fragmentary diagrammatic view of a relay according to the present invention, in the inoperative position.

In FIG. 1, there is shown diagrammatically the coil 1, the core 2 and the yoke 3 of an electromagnet adapted to move an armature 4 between a first position (for example the inoperative position shown in FIG. 1) and a second position (for example the operative position shown in FIG. 2).

The yoke 3 is fastened in a conventional manner (not shown) to an insulating base 5 supporting three fixed conducting contact studs 6, 7 and 8, respectively, constituting outlet terminals of the relay.

Two spaced and coplanar resilient U-shaped tongues 9, 10 providing the first and second arms (11, 12) and third and fourth arms (13, 14) respectively are adapted to bear resiliently with the outer faces of these arms against the inner faces of the fixed contact studs in which fixed contact inserts such as 15 are set.

The outer faces of arms 11, 12, 13 and 14 carry likewise electric contact surfaces 16, 17, 18 and 19 which, according to this invention, consist very advantageously of metal insert as shown in the drawing. The contact faces 16, 17, on the one hand, and 18, 19 on the other hand, are electrically interconnected, for example through the tongues 9 and 10.

The relay comprises in the known fashion a first movable control member 20 electrically insulated from the fixed contact studs and from the contact surfaces. This control member is associated kinematically with the armature 4 and when the latter is moved towards its second position, (for instance the position shown in FIG. 2) it engages the outer surface of the first arm 11 in order to move the first contact surface 16 away from the first contact stud 6.

If as shown in the drawing, the relay comprises in the known manner two pairs of arms, or two tongues 9, 10 having their arms disposed side by side so that the first control member extends between the first arm 11 and the fourth arm 14, this member will also engage the fourth arm 14 during the movement of armature 4 towards its first position (FIG. 1), in order to move the contact surface 19 away from the first contact stud 6, while allowing the first arm 11 to resume its position of engagement, through its surface 16, with the contact stud 6, this action being inverted when the armature is moved towards its second position.

According to the present invention, the relay further comprises a second control member 21 associated kinematically with the armature 4 and also with the first control member 20, this second control member 21 being movable in a direction opposed to that of the first control member 20; this second control member 21 engages with one of its ends, during the movement of the armature towards its second position (FIG. 2), the outer face of the second arm 12 in order to move the contact surface 17 away from contact stud 7 while the first and second contact surfaces 16, 17 move towards each other by performing substantially identical and simultaneous movement.

A third control member 22 fixed in relation to the second member 21 may be provided for engaging with its end the arm 13 in order to move the contact surface 18 away from contact stud 8 when the armature resumes its first position.

The first control member 20 may consist for example of a rigid rocker oscillating about a transverse pivot pin 23 located intermediate the ends **20*a*, 20*b* of said rocker and fixed in relation to the electromagnet 1–3 and substantially perpendicular to the major dimension of the arms 11–14. The driven end 20*a* of rocker 20 is positively connected to the armature 4 and its driving end 20*b* provided for example with an insulating head engages a predetermined arm (for exemple the first arm 11) for a given position of the armature (the second position in this example), so as to free this arm completely in the other position of said armature; thus, as clearly shown in FIG. 1, a certain gap is left between the driving end 20*b* of rocker 20 and the first arm 11**.

The second and third control members 21, 22 consist for example of a pair of parallel push members provided with insulating heads at their operative ends (**21*a*, 22*a*) and constitute the side arms or portions of a strap of which the back 24 substantially parallel to the axis 25 of the electromagnet is constantly urged against the end 4*a* of armature 4, for example by a spring 26 reacting against the yoke 3**.

The movements of the control members are synchronized by forming through the back 24 of the strap a slot 27 engaged by the driven end **20*a*** of the rocker.

In addition, the pivot pin 23 of the rocker is located preferably in the middle of the segment interconnecting the ends **20*a* and 20*b*** of this rocker.

Though the drawing illustrates only one central contact stud provided with two contact faces or inserts, it would of course also be possible to provide two separate central contact studs each provided with a contact face, in order to constitute two independent contact circuits.

On the other hand, other contact circuits may be disposed in succession along the axis of pivot pin 23, these circuits having in common said axis and the same strap.

The return spring 26 permits of clearing the insulating push members and thus improving the shock resistance of the relay.

The movement of translation of the strap may be guided for example by means of bores (not shown) formed through this strap and slidably engaged by a pair of rods extending at right angles to the yoke 3. Thus, the fixed and movable contacts is better centered than if the strap were rigid with the armature 4 and allowed to rotate about a pivot pin carried by this armature.

Of course, complementary means known in the art are provided for holding the resilient tongues 9, 10 in planes perpendicular to the movements of their arms.

If desired, according to the present invention and as mentioned in the article to which reference is made in the preamble of the present specification, these resilient tongues 9, 10 may be more or less asymmetrical in order to cause a slight frictional contact between their contact surfaces and the fixed contacts studs, a feature that could not be obtained with an arrangement according to the patents cited hereinabove.

What is claimed as new is:

1. An electromagnetic relay comprising an electromagnet, an armature movable between a first position and a second position, first and second contact studs fixed in relation to the electromagnet and having mutually facing inner faces, a first pair of arms consisting of first and second arms tending to move away from each other and having outer faces, respectively, carrying a first and a second electric contact surface electrically interconnected and bearing resiliently, in the first position of said armature, against the inner faces of the first and second contact studs, respectively, said relay also comprising a first movable control member associated kinematically with the armature and adapted, during a movement of said armature towards its second position, to engage the outer face of the first arm for moving the first contact surface away from the first contact stud, said relay further comprising a second control member associated kinematically with the armature and the first control member, and movable in a direction opposed to that of the movement of the first control member, said second control member being adapted, during a movement of said armature towards its second position to engage the outer face of the second arm in order to move the second contact surface away from the second contact stud, the first and second contact surfaces moving towards each other by performing substantially identical and simultaneous movements.

2. Relay according to claim 1, wherein the first control member comprises a rigid rocker oscillating about an intermediate pivot pin fixed in relation to the electromagnet, said rocker having a driven end positively connected to the armature so as to follow the movements thereof, and a driving end bearing against an arm to be actuated in one position of said armature and releasing completely said arm in the other position of said armature.

3. Relay according to claim 1, wherein the second control member is a push member adapted to accomplish a transverse movement of translation having the same amplitude as the movement of one end of said armature.

4. Electromagnetic relay according to claim 1, comprising in addition a third contact stud and a second pair of arms consisting of a third and a fourth arms tending to move resiliently away from each other and carrying a third and a fourth contact surfaces, respectively, said third and fourth contact surfaces being electrically interconnected, the two pairs of arms, disposed side by side, having their first and fourth arms disposed on either side, respectively, of the first control member, and their second and third arms disposed in the vicinity of the second and third contact studs, respectively, and wherein the first control member is adapted to actuate the first arm in the second position of said armature and the fourth arm in the first position of said armature, this relay further comprising a third control member fixed in relation to the second control member in order to move the third contact surface away from the third contact stud during the movement of said armature towards its first position.

5. Relay according to claim 4, wherein the first contact stud is common to the first and fourth arms.

6. Relay according to claim 4, wherein the first control member comprises a rigid rocker oscillating about an intermediate pivot pin fixed in relation to the electromagnet, said rocker having a driven end positively connected to the armature so as to follow the movements thereof, and a driving end bearing against an arm to be actuated in one position of said armature and releasing completely said arm in the other position of said armature.

7. Relay according to claim 4, wherein the second control member is a first push member adapted to accomplish a transverse movement of translation having the same amplitude as the movement of one end of said armature.

8. Relay according to claim 7, wherein the third control member is a second push member parallel to the first push member and forming therewith the lateral portions of a strap having a back substantially parallel to the electromagnet axis and constantly urged against the armature end.

9. Relay according to claim 8, wherein the first control member comprises a rigid rocker oscillating about an intermediate pivot pin fixed in relation to the electromagnet, said rocker having a driven end positively connected to the armature so as to follow the movements thereof, and a driving end bearing against an arm to be actuated in one position of said armature and releasing completely said arm in the other position of said armature, and wherein the back of the strap comprises a slot engaged by the driven end of the rocker constituting the first control member.

* * * * *